US011086275B2

(12) United States Patent
Chen et al.

(10) Patent No.: US 11,086,275 B2
(45) Date of Patent: Aug. 10, 2021

(54) WEARABLE DEVICE, AND NOTIFICATION SYSTEM AND NOTIFICATION METHOD THEREOF

(71) Applicants: Kai-Yi Chen, Taipei (TW); Cheng-Yuan Wei, Taipei (TW); Chun-Yu Yang, Taipei (TW); Yu-Hao Wu, Taipei (TW); Ting-Wei Wu, Taipei (TW); Ruei-Hong Hong, Taipei (TW)

(72) Inventors: Kai-Yi Chen, Taipei (TW); Cheng-Yuan Wei, Taipei (TW); Chun-Yu Yang, Taipei (TW); Yu-Hao Wu, Taipei (TW); Ting-Wei Wu, Taipei (TW); Ruei-Hong Hong, Taipei (TW)

(73) Assignee: COMPAL ELECTRONICS, INC., Taipei (TW)

( * ) Notice: Subject to any disclaimer, the term of this patent is extended or adjusted under 35 U.S.C. 154(b) by 420 days.

(21) Appl. No.: 16/136,286

(22) Filed: Sep. 20, 2018

(65) Prior Publication Data

US 2019/0339652 A1 Nov. 7, 2019

(30) Foreign Application Priority Data

May 7, 2018 (TW) ..... 107115478

(51) Int. Cl.
*G04G 21/00* (2010.01)
*G04G 21/04* (2013.01)
(Continued)

(52) U.S. Cl.
CPC ..... *G04G 21/00* (2013.01); *G04G 9/007* (2013.01); *G04G 21/04* (2013.01); *G08B 5/22* (2013.01)

(58) Field of Classification Search
CPC ..... G04G 21/00; G04G 9/007; G04G 21/04; G04G 21/08; G08B 5/22; H04N 21/47205; G04F 3/00; G01B 5/00
(Continued)

(56) References Cited

U.S. PATENT DOCUMENTS 4,019,037 A * 4/1977 Monna ..... G04G 9/007 708/111
4,109,457 A * 8/1978 Laesser ..... G04C 3/005 368/27
(Continued)

FOREIGN PATENT DOCUMENTS

CN 1811620 8/2006
CN 100361030 1/2008
(Continued)

OTHER PUBLICATIONS

"Office Action of Taiwan Counterpart Application", dated Jun. 10, 2019, pp. 1-7.

*Primary Examiner* — Edwin A. Leon
(74) *Attorney, Agent, or Firm* — JCIPRNET

(57) ABSTRACT

A wearable device, and a notification system and a notification method thereof are provided. The wearable device includes a rotatable ring, multiple switches, and a communication module. The wearable device obtains a control signal by rotating the rotatable ring to trigger part of the switches, and transmits a mode signal to an electronic apparatus in response to the control signal. After receiving the mode signal, the electronic apparatus switches to a corresponding mode.

16 Claims, 6 Drawing Sheets

(51) Int. Cl.
*G04G 9/00* (2006.01)
*G08B 5/22* (2006.01)

(58) Field of Classification Search
USPC ..... 368/10, 15–20
See application file for complete search history.

(56) References Cited

U.S. PATENT DOCUMENTS

| | | | | |
|---|---|---|---|---|
| 6,535,461 | B1 * | 3/2003 | Karhu | G04C 3/001 368/10 |
| 6,575,618 | B1 * | 6/2003 | Inoue | G01D 5/2451 250/231.13 |
| 6,998,984 | B1 * | 2/2006 | Zittrain | G08B 3/1066 340/539.11 |
| 10,013,073 | B2 * | 7/2018 | Kim | G04C 3/005 |
| 10,564,738 | B2 * | 2/2020 | Lim | G06F 1/163 |
| 2002/0101457 | A1 * | 8/2002 | Lang | G06F 3/04892 715/856 |
| 2007/0247976 | A1 * | 10/2007 | Capozzi | G04G 21/00 368/82 |
| 2012/0120567 | A1 * | 5/2012 | Hsieh | G04G 17/045 361/679.01 |
| 2019/0025768 | A1 * | 1/2019 | Dangy Caye | G04G 21/08 |

FOREIGN PATENT DOCUMENTS

| | | |
|---|---|---|
| CN | 104731724 | 6/2015 |
| CN | 104853043 | 8/2015 |
| CN | 206657189 | 11/2017 |
| TW | 584794 | 4/2004 |
| TW | 201523173 | 6/2015 |

* cited by examiner

WEARABLE DEVICE, AND NOTIFICATION SYSTEM AND NOTIFICATION METHOD THEREOF

CROSS-REFERENCE TO RELATED APPLICATION

This application claims the priority benefit of Taiwan application serial no. 107115478, filed on May 7, 2018. The entirety of the above-mentioned patent application is hereby incorporated by reference herein and made a part of this specification.

BACKGROUND

Technical Field

The disclosure relates to a watch and applications thereof, and more particularly relates to a wearable device with smart notification, and a notification system and a notification method thereof.

Description of Related Art

With the rapid development of mobile communication technology in recent years, the functions that mobile communication devices can provide become more and more diverse. Because of the market trends and consumers' expectations, wearable electronic devices, such as smart watches, are drawing more attention than ever. For enthusiasts of traditional wearable devices, however, there is no smart watch on the market that can replace the traditional wearable devices. Therefore, how to provide a wearable device with a smart function is one of the issues that need to be addressed.

SUMMARY

The disclosure provides a wearable device, and a notification system and a notification method thereof, which enable the wearable device to provide a smart notification function.

A notification system based on a wearable device according to the disclosure includes: an electronic apparatus and the wearable device. The wearable device includes: an rotatable ring; a plurality of switches, part of which are triggered through rotation of the rotatable ring to obtain a control signal; and a communication module coupled to the switches and transmitting a mode signal to the electronic apparatus in response to the control signal. After receiving the mode signal, the electronic apparatus switches to a corresponding mode based on the mode signal.

In an embodiment of the disclosure, the wearable device further includes: a first rotating plate engaged with the rotatable ring and rotating with the rotatable ring, wherein a surface of the first rotating plate has a plurality of mode names. The rotatable ring includes a hollow area to expose a fixing panel, the fixing panel is disposed above the first rotating plate, and the fixing panel has a first opening to expose one of the mode names. The first rotating plate is driven to rotate by the rotatable ring, so that one of the mode names is exposed in the first opening and part of the switches are triggered to obtain the control signal.

In an embodiment of the disclosure, the wearable device further includes: a second rotating plate including a plurality of notification items, wherein the fixing panel has a second opening to expose one of the notification items; and a servomotor driving the second rotating plate to rotate. When the electronic apparatus receives a notification message, the electronic apparatus determines whether to transmit the notification message to the wearable device according to a current mode. When the wearable device receives the notification message from the electronic apparatus via the communication module, the servomotor is driven based on the notification message to rotate the second rotating plate, so that one of the notification items corresponding to the notification message is displayed in the second opening.

In an embodiment of the disclosure, the wearable device further includes: a plurality of contacts disposed in the rotatable ring. Rotation of the rotatable ring brings part of the contacts into contact with part of the switches to obtain the control signal.

In an embodiment of the disclosure, the switches have different preset voltages, and a total voltage level obtained by calculating a total of the preset voltages of the part of the switches that are triggered serves as the control signal.

In an embodiment of the disclosure, the communication module is a Bluetooth unit.

A wearable device according to the disclosure includes: an rotatable ring; a plurality of switches, part of which are triggered through rotation of the rotatable ring to obtain a control signal; and a communication module coupled to the switches and transmitting a mode signal to an electronic apparatus in response to the control signal, so that the electronic apparatus switches to a corresponding mode based on the mode signal.

A notification method according to the disclosure is for a wearable device and an electronic apparatus. The notification method includes: pairing the wearable device with the electronic apparatus, wherein the wearable device includes an rotatable ring, a plurality of switches, and a communication module; triggering part of the switches based on rotation of the rotatable ring to obtain a control signal; transmitting a mode signal to the electronic apparatus via the communication module in response to the control signal; and switching the electronic apparatus to a corresponding mode based on the mode signal after the electronic apparatus receives the mode signal.

Based on the above, the wearable device is provided with a rotatable ring, a plurality of switches, and a communication module inside, and the mode of the electronic apparatus may be adjusted by calculating the control signal obtained through rotation of the rotatable ring. Accordingly, the wearable device is enabled to provide a smart notification function.

To make the aforementioned and other features of the disclosure more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DETAILED DESCRIPTION OF DISCLOSED EMBODIMENTS

Figure 1:
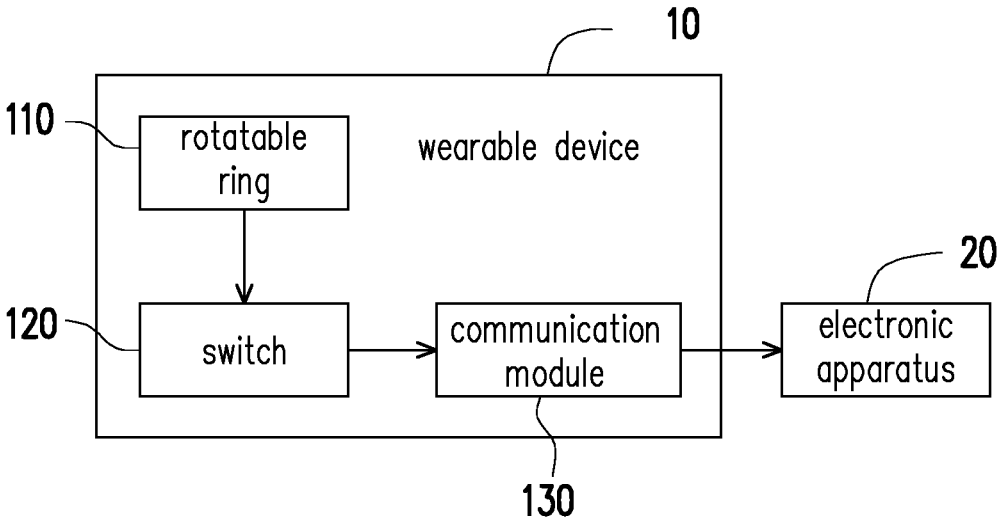
FIG. 1 is a block diagram showing a control relationship between the wearable device and the electronic apparatus according to an embodiment of the disclosure.

FIG. 1 is a block diagram showing a control relationship between a wearable device and an electronic apparatus according to an embodiment of the disclosure. Referring to FIG. 1, the wearable device 10 includes a rotatable ring 110, a switch 120, and a communication module 130. The wearable device 10 is, for example, an analog wristwatch or the like. The electronic apparatus 20 is, for example, a smart phone, a tablet computer, a laptop computer, or a desktop computer that has a communication function. In the wearable device 10, the switch 120 is triggered by rotation of the rotatable ring 110, and the communication module 130 is driven by the switch 120 to transmit a mode signal to the electronic apparatus 20. Accordingly, the electronic apparatus 20 switches modes according to the received mode signal. The switch 120 is, for example, a limit switch or any two-stage switch, and the communication module 130 is, for example, a physical device, such as a circuit or a chip, that supports wireless communication protocols such as Wi-Fi, RF (radio frequency), 2.4G, Bluetooth, etc.

Figure 2:
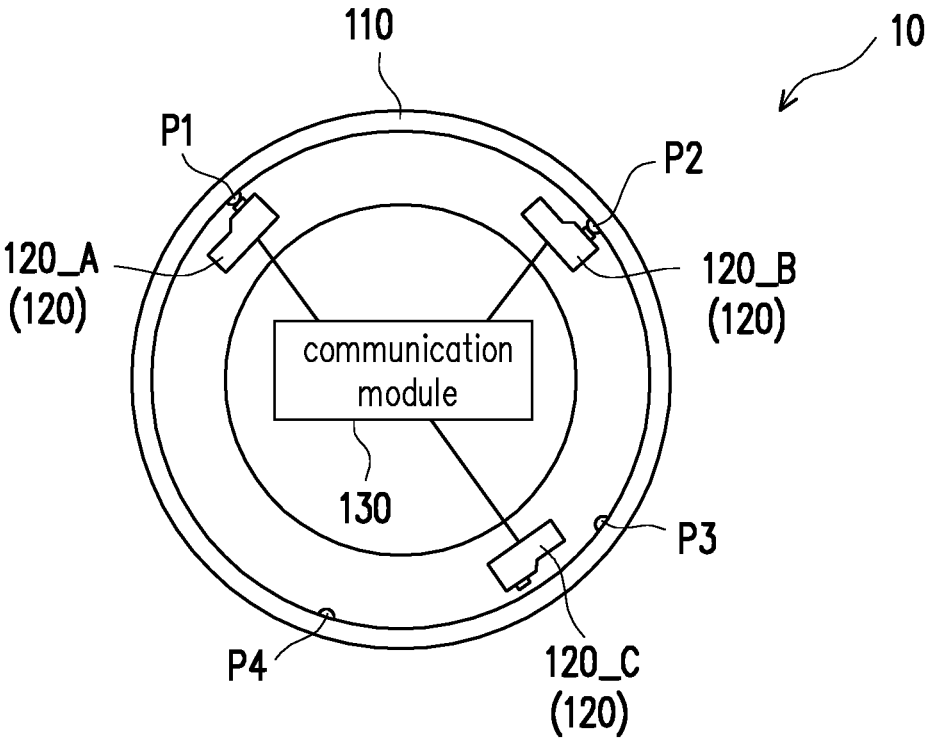
FIG. 2 is a schematic diagram showing members of the wearable device according to an embodiment of the disclosure.

FIG. 2 is a schematic diagram showing members of the wearable device according to an embodiment of the disclosure. In this embodiment, only some of the members are shown. Other members that are not shown here are similar to those of a general wearable device and therefore will not be described hereinafter. Referring to FIG. 2, the wearable device 10 includes the rotatable ring 110, switches 120, and the communication module 130. In this embodiment, the wearable device 10 further includes a plurality of contacts P1 to P4 that are disposed on the rotatable ring 110. Here, only three switches 120 (switches 120_A, 120_B, and 120_C) and four contacts (contacts P1 to P4) are shown.

In this embodiment, the switches 120_A to 120_C are stationary, and the contacts P1 to P4 are rotated through rotation of the rotatable ring 110. When the rotatable ring 110 is rotated, some of the contacts P1 to P4 come into contact with some of the switches 120, so as to trigger some of the switches 120, and a control signal is generated from some of the switches 120 that are triggered. The control signal is, for example, a total voltage level.

Specifically, the switches 120_A, 120_B, and 120_C have different preset voltages. For example, when the switch 120_A is triggered, a first preset voltage is obtained; when the switch 120_B is triggered, a second preset voltage is obtained; and when the switch 120_C is triggered, a third preset voltage is obtained. Some of the switches 120_A to 120_C may come into contact with some of the contacts P1 to P4. For example, in this embodiment, the wearable device 10 is configured such that two switches 120 come into contact with two contacts at the same time. When two of the switches 120 are triggered, the total of the preset voltages of the two switches 120 that are triggered is calculated, so as to obtain the total voltage level.

For example, it is assumed that the first preset voltage corresponding to the switch 120_A is 1V, the second preset voltage corresponding to the switch 120_B is 3V, and the third preset voltage corresponding to the switch 120_C is 5V. In addition, it is assumed that this embodiment requires three modes, that is, a first mode, a second mode, and a third mode. Thus, the setting is made such that two switches 120 will be triggered at the same time. Table 1 shows examples of the two switches 120 corresponding to each of the three modes. The first mode is set corresponding to a case where the switch 120_A and the switch 120_B are triggered at the same time, the second mode is set corresponding to a case where the switch 120_B and the switch 120_C are triggered at the same time, and the third mode is set corresponding to a case where the switch 120_A and the switch 120_C are triggered at the same time.

TABLE 1

| | Switch 120_A | Switch 120_B | Switch 120_C | Total voltage level |
|---|---|---|---|---|
| First mode | 1 | 3 | 0 | 4 |
| Second mode | 0 | 3 | 5 | 8 |
| Third mode | 1 | 0 | 5 | 6 |

Figure 3A:
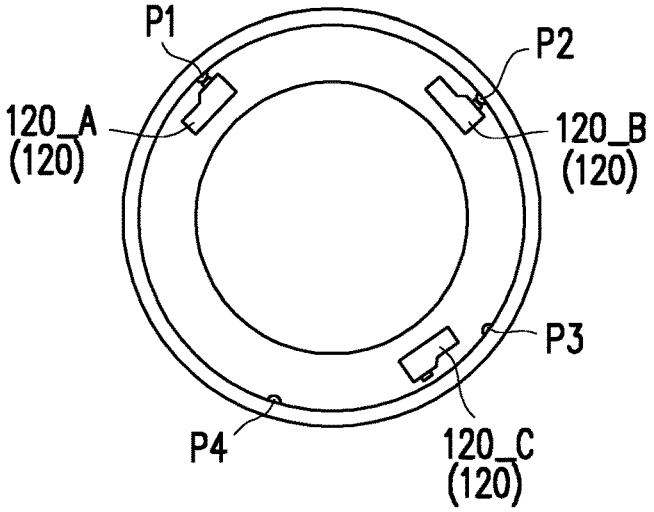
FIG. 3A to FIG. 3C are schematic diagrams showing that different switches are triggered according to an embodiment of the disclosure.
Figure 3B:
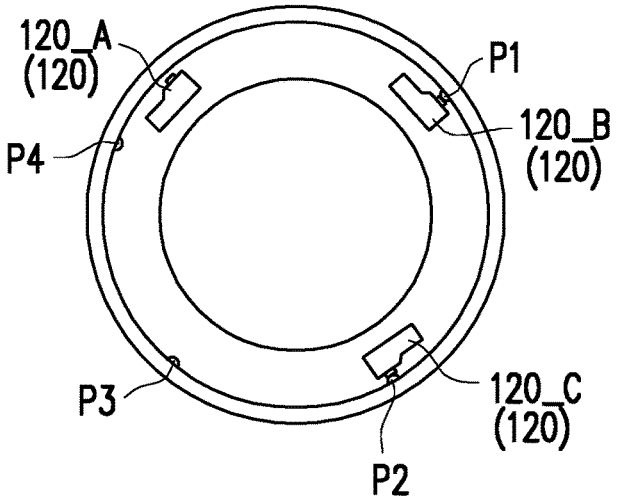
Figure 3C:
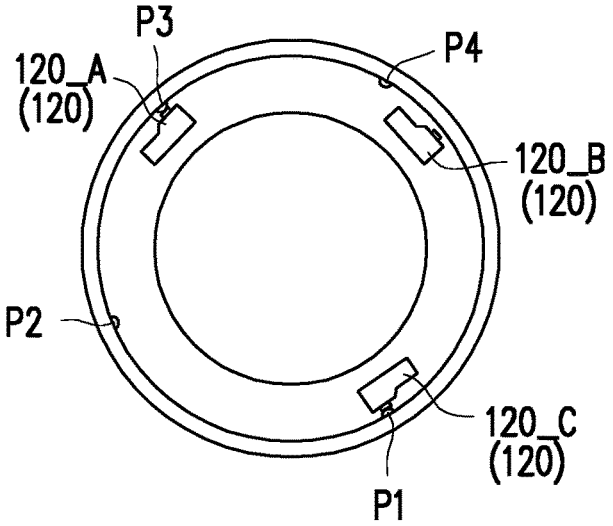

FIG. 3A to FIG. 3C are schematic diagrams showing that different switches are triggered according to an embodiment of the disclosure. FIG. 3A shows that the switch 120_A and the switch 120_B are triggered at the same time, FIG. 3B shows that the switch 120_B and the switch 120_C are triggered at the same time, and FIG. 3C shows that the switch 120_A and the switch 120_C are triggered at the same time. FIG. 3A to FIG. 3C will be described below with reference to Table 1.

In FIG. 3A, the rotation of the rotatable ring 110 brings the switch 120_A and the switch 120_B into contact with the contacts P1 and P2 respectively (that is, triggered at the same time), which indicates that the user wants to switch the electronic apparatus 20 to the first mode. At this time, the communication module 130 transmits a mode signal in response to 4V (that is, a signal for indicating the first mode) to the electronic apparatus 20 based on the preset setting.

Referring to FIG. 3B, the rotation of the rotatable ring 110 brings the switch 120_B and the switch 120_C into contact with the contacts P1 and P2 respectively, which indicates that the user wants to switch the electronic apparatus 20 to the second mode. At this time, the communication module 130 transmits a mode signal in response to 8V (that is, a signal for indicating the second mode) to the electronic apparatus 20 based on the preset setting.

Referring to FIG. 3C, the rotation of the rotatable ring 110 brings the switch 120_A and the switch 120_C into contact with the contacts P3 and P1 respectively, which indicates that the user wants to switch the electronic apparatus 20 to the third mode. At this time, the communication module 130 transmits a mode signal in response to 6V (that is, a signal for indicating the third mode) to the electronic apparatus 20.

In other embodiments, two, four or more switches 120 may be disposed depending on the modes required by the electronic apparatus 20, and the number of contacts on the rotatable ring 110 may be increased or decreased according to the number of the switches 120.

Figure 4:
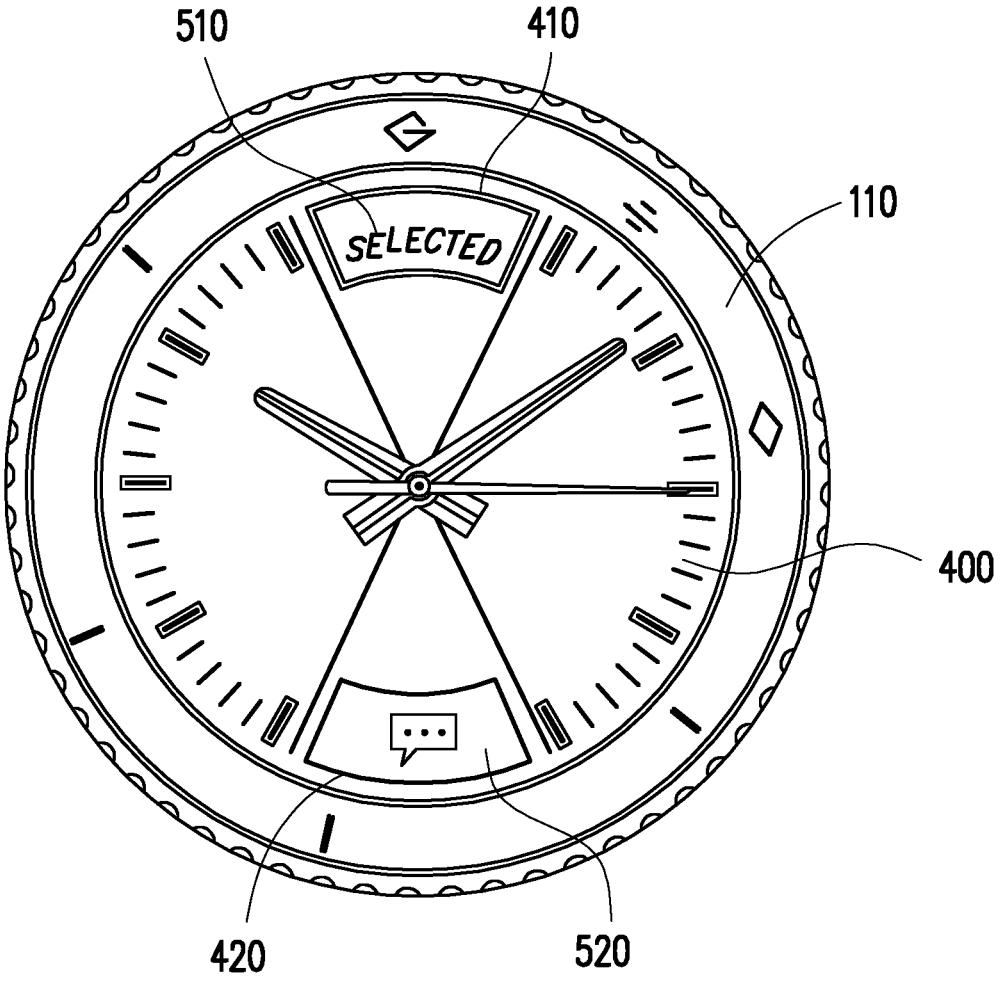
FIG. 4 is a schematic diagram showing an appearance of the wearable device according to an embodiment of the disclosure.
Figure 5A:
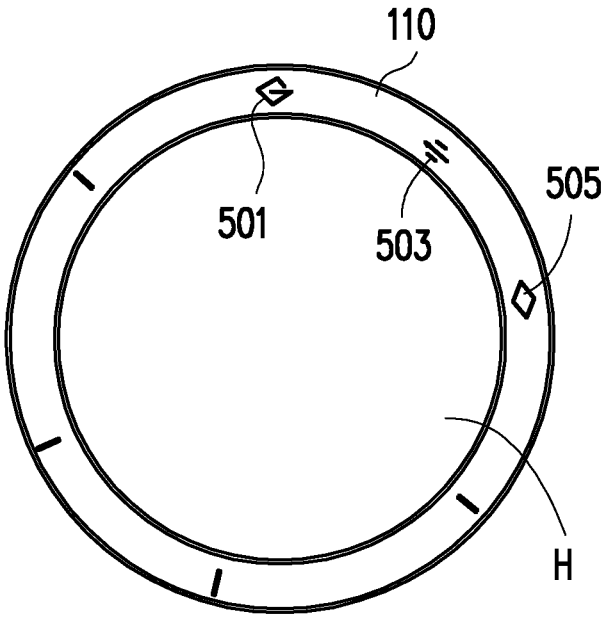
FIG. 5A to FIG. 5D are schematic diagrams respectively showing each member of the wearable device according to an embodiment of the disclosure.
Figure 5B:
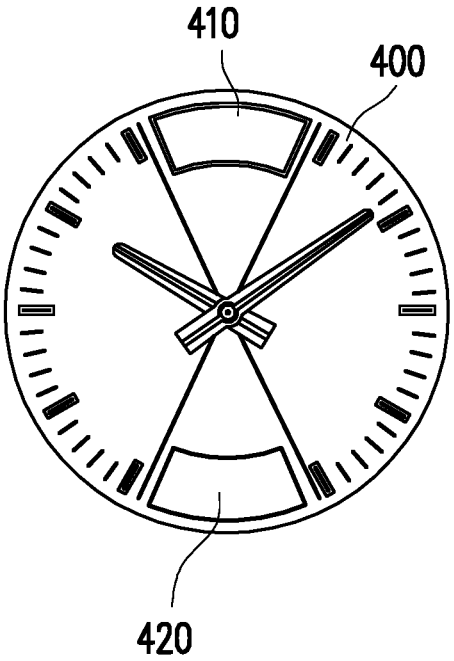
Figure 5C:
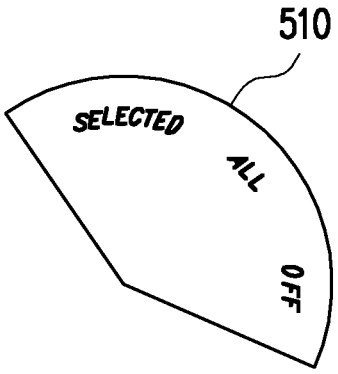
Figure 5D:
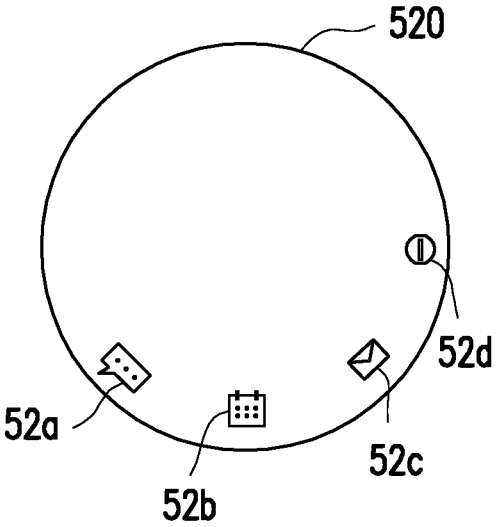
Figure 6:
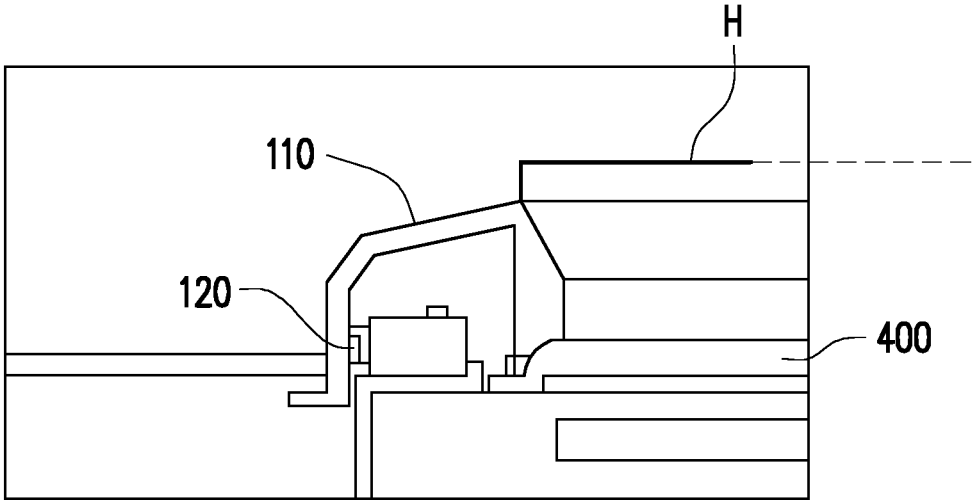
FIG. 6 is a schematic cross-sectional diagram of the rotatable ring according to an embodiment of the disclosure.

FIG. 4 is a schematic diagram showing an appearance of the wearable device according to an embodiment of the disclosure. FIG. 5A to FIG. 5D are schematic diagrams respectively showing each member of the wearable device according to an embodiment of the disclosure. FIG. 6 is a schematic cross-sectional diagram of the rotatable ring according to an embodiment of the disclosure. A relationship between the members of the wearable device 10 is further described below with reference to FIG. 4 to FIG. 6.

The wearable device 10 further includes a fixing panel 400, a first rotating plate 510, and a second rotating plate 520. The first rotating plate 510 and the second rotating plate 520 are disposed under the fixing panel 400. In this embodiment, the first rotating plate 510 has a sector shape and is disposed above the second rotating plate 520. The fixing panel 400 has a first opening 410 and a second opening 420. The first opening 410 is for exposing a partial area of the first rotating plate 510. The second opening 420 is for exposing a partial area of the second rotating plate 520.

The rotatable ring 110 is, for example, a hollow annular member as shown in FIG. 6, and the switches 120 are provided inside the rotatable ring 110. As shown in FIG. 5A, the rotatable ring 110 has a hollow area H in the center, and the fixing panel 400 is exposed in the hollow area H.

The first rotating plate 510 and the rotatable ring 110 are engaged with each other through an engagement member (not shown), by which the first rotating plate 510 rotates with the rotatable ring 110. Moreover, a plurality of mode names, such as "SELECTED", "ALL", and "OFF", are printed on a surface of the first rotating plate 510. The user may rotate the rotatable ring 110 to drive the first rotating plate 510 to rotate, so as to display one of the mode names in the first opening 410 and trigger the switches 120 to generate the control signal (for example, the total voltage level). In addition, a surface of the rotatable ring 110 is printed with mode patterns 501, 503, and 505 corresponding to the mode names "SELECTED", "ALL", and "OFF" on the first rotating plate 510.

For example, it is assumed that the mode names "SELECTED", "ALL", and "OFF" correspond to the third mode, the second mode, and the first mode of Table 1 respectively. When the rotatable ring 110 is rotated to display the mode name "SELECTED" in the first opening 410, the mode pattern 501 is located above the first opening 410, and the switch 120_A and the switch 120_C are triggered at the same time (as shown in FIG. 3C). When the rotatable ring 110 is rotated to display the mode name "ALL" in the first opening 410, the mode pattern 503 is located above the first opening 410, and the switch 120_B and the switch 120_C are triggered at the same time (as shown in FIG. 3B). When the rotatable ring 110 is rotated to display the mode name "OFF" in the first opening 410, the mode pattern 505 is located above the first opening 410, and the switch 120_A and the switch 120_B are triggered at the same time (as shown in FIG. 3A). In other words, the mode name "SELECTED" corresponds to the first mode of Table 1, the mode name "ALL" corresponds to the second mode of Table 1, and the mode name "OFF" corresponds to the third mode of Table 1.

In addition, the wearable device 10 further includes a positioning member (not shown) for accurately positioning one of the three modes on the first rotating plate 510 in the first opening 410 when the rotatable ring 110 is rotated.

In this embodiment, the first rotating plate 510 has a sector shape. However, in other embodiments, the first rotating plate 510 may be circular. In addition, in other embodiments, the second rotating plate 520 and the second opening 420 may be omitted. That is, only the first rotating plate 510 and the first opening 410 are disposed.

The second rotating plate 520 has a plurality of notification items 52*a* to 52*d*, and one of the notification items 52*a* to 52*d* is exposed in the second opening 420 based on a notification message received from the electronic apparatus 20. The notification item 52*a* is an SMS (Short Message Service) notification, the notification item 52*b* is a schedule notification, the notification item 52*c* is a mail notification, and the notification item 52*d* is a call notification. The second rotating plate 520 is rotated based on the notification message received from the electronic apparatus 20. Another example is provided below.

Figure 7:
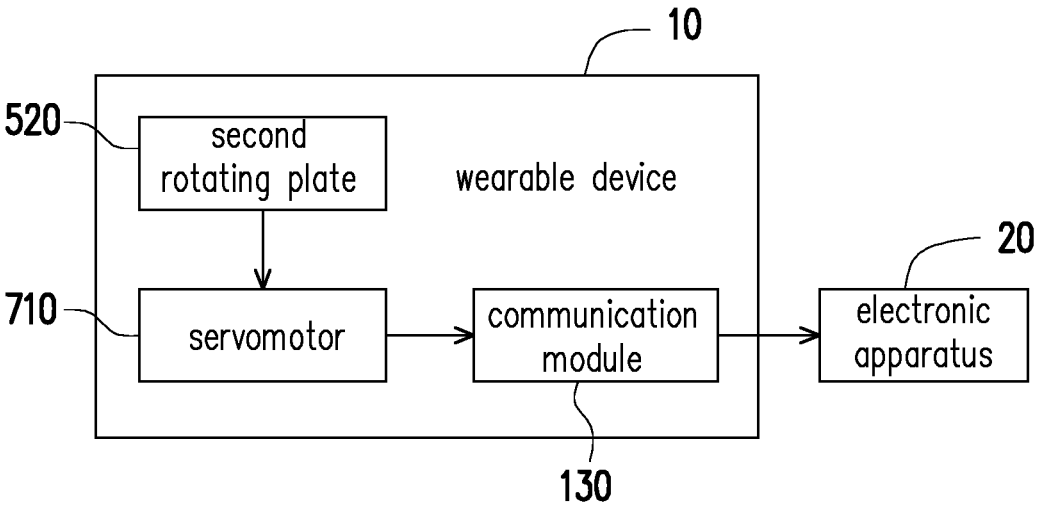
FIG. 7 is a block diagram showing a control relationship between the wearable device and the electronic apparatus according to an embodiment of the disclosure.

FIG. 7 is a block diagram showing a control relationship between a wearable device and an electronic apparatus according to an embodiment of the disclosure. Referring to FIG. 7, the wearable device 10 further includes a second rotating plate 520 and a servomotor 710. The servomotor 710 is configured to drive the second rotating plate 520 to rotate. When the electronic apparatus 20 receives a notification message, the electronic apparatus 20 determines whether to transmit the notification message to the wearable device 10 according to the current mode.

Here, a corresponding application is installed in the electronic apparatus 20. When the electronic apparatus 20 receives a notification message, the application determines the current mode of the electronic apparatus 20 to determine whether to transmit the notification message to the wearable device 10.

For example, if the current mode of the electronic apparatus 20 is "SELECTED", the application determines whether to transmit the notification message, such as a call notification, an SMS notification, a schedule notification, or a mail notification, to the wearable device 10 according to a preset priority list. That is, if the source transmitting the notification message is in the priority list, the notification message is transmitted; and if the source transmitting the notification message is not in the priority list, the notification message is not transmitted.

If the current mode of the electronic apparatus 20 is "ALL", the application transmits all notification messages, such as a call notification, an SMS notification, a schedule notification, or a mail notification, to the wearable device 10. If the current mode of the electronic apparatus 20 is "OFF", the application does not transmit any notification message to the wearable device 10.

An example is further provided below based on the first mode. When the rotatable ring 110 of the wearable device 10 is rotated to display the mode name "SELECTED" in the first opening 410, a mode signal indicating the first mode is transmitted to the electronic apparatus 20 via the communication module 130, so that the electronic apparatus 20 is switched to the first mode. In the first mode, the electronic apparatus 20 only transmits the notification message transmitted from the source that is in the priority list to the wearable device 10. For example, when receiving a SMS notification transmitted from the source that is in the priority list, the electronic apparatus 20 transmits the SMS notification to the wearable device 10. At this time, the communication module 130 of the wearable device 10 drives the servomotor 710 to rotate the second rotating plate 520, so that the second rotating plate 520 rotates to expose the notification item 52*a* in the second opening 420.

Figure 8:
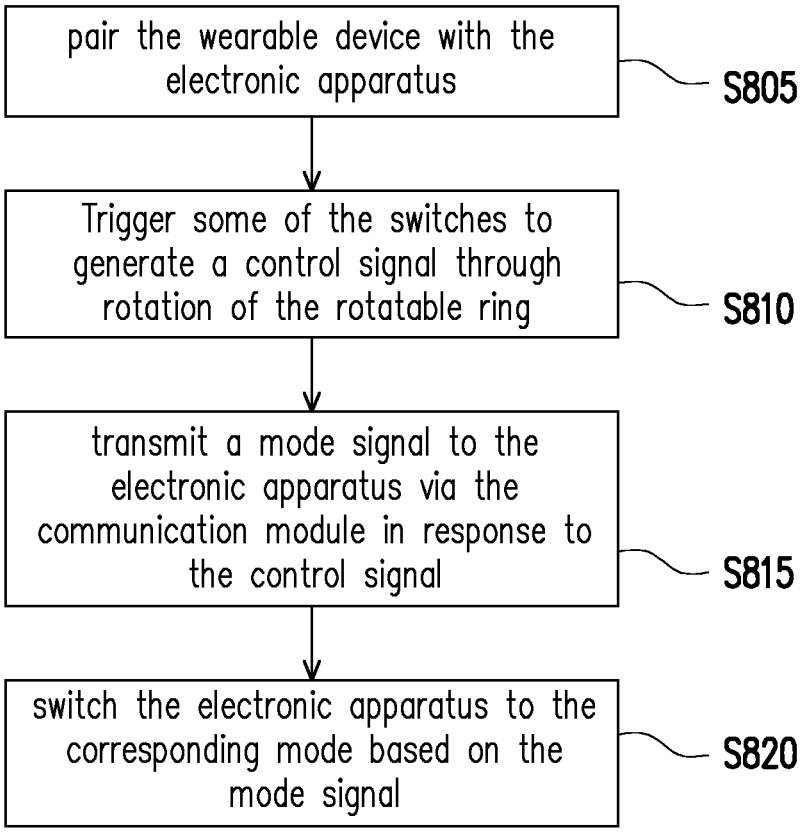
FIG. 8 is a flowchart showing the notification method according to an embodiment of the disclosure.

FIG. 8 is a flowchart showing a notification method according to an embodiment of the disclosure. FIG. 8 is described hereinafter with reference to the wearable device 10 and the electronic apparatus 20 described above. In Step S805, the wearable device 10 is paired with the electronic apparatus 20. For example, the communication module 130 of the wearable device 10 is a Bluetooth unit, and the electronic apparatus 20 is also provided with a Bluetooth unit. Before the wearable device 10 and the electronic apparatus 20 communicate with each other, Bluetooth pairing is carried out.

Then, in Step S810, some of the switches 120 are triggered to generate a control signal (refer to the descriptions of FIG. 3A to FIG. 3C and Table 1) through rotation of the rotatable ring 110. Next, in Step S815, a mode signal is transmitted to the electronic apparatus 20 via the communication module 130 in response to the control signal. Thereafter, in Step S820, after the electronic apparatus 20 receives the mode signal, the electronic apparatus 20 switches to the corresponding mode based on the mode signal.

The rotation of the rotatable ring 110 puts the mode pattern 501 or the mode pattern 503 above the first opening 410. As the rotatable ring 110 is rotated, the first rotating plate 510 is driven to rotate, such that the mode name "SELECTED" or "ALL" is displayed through the first opening 410 of the fixing panel 400. Further, the communication module 130 is driven by the rotatable ring 110 or the first rotating plate 510 to send a mode signal corresponding to the first mode or the second mode. In the first mode or the second mode, the wearable device 10 may receive the notification message from the electronic apparatus 20.

In addition, the rotatable ring 110 may be rotated to put the mode pattern 505 above the first opening 410. As the rotatable ring 110 is rotated, the first rotating plate 510 is driven to rotate, such that the mode name "OFF" is displayed through the first opening 410 of the fixing panel 400. Moreover, the communication module 130 is driven by the rotatable ring 110 or the first rotating plate 510 to send a mode signal corresponding to the third mode. In the third mode, the wearable device 10 does not receive any notification message from the electronic apparatus 20.

When the electronic apparatus 20 receives a new notification message (such as a SMS notification, a call notification, a mail notification, or a schedule notification), the electronic apparatus 20 uses the application to determine whether to transmit the notification message to the wearable device 10 according to the current mode. When the wearable device 10 receives the notification message, the second rotating plate 520 is driven by the servomotor 710 to rotate to the corresponding notification item.

To sum up, the wearable device of the disclosure is provided with the rotatable ring, a plurality of switches, and the communication module inside. The switches have different preset voltages, and the total voltage level of the switches triggered by the rotation of the rotatable ring is calculated, so as to adjust the mode of the electronic apparatus. In addition, the wearable device may further receive a notification message from the electronic apparatus, and drive the second rotating plate to rotate accordingly. Thus, the above embodiment enables the wearable device to provide a smart notification function.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A notification system based on a wearable device, comprising:

an electronic apparatus; and the wearable device, comprising:

a rotatable ring;

a plurality of switches, part of which are triggered to generate a control signal through rotation of the rotatable ring; and a communication module coupled to the switches and transmitting a mode signal to the electronic apparatus in response to the control signal, and a first rotating plate engaged with the rotatable ring and rotating with the rotatable ring, wherein a surface of the first rotating plate has a plurality of mode names, wherein after receiving the mode signal, the electronic apparatus switches to a corresponding mode based on the mode signal, the rotatable ring comprises a hollow area to expose a fixing panel, the fixing panel is disposed above the first rotating plate, and the fixing panel has a first opening to expose one of the mode names, the first rotating plate is driven to rotate by the rotatable ring, so that one of the mode names is exposed in the first opening and part of the switches are triggered to obtain the control signal.

2. The notification system based on the wearable device according to claim 1, wherein the wearable device further comprises:

a second rotating plate comprising a plurality of notification items, wherein the fixing panel has a second opening to expose one of the notification items; and a servomotor driving the second rotating plate to rotate.

3. The notification system based on the wearable device according to claim 2, wherein when the electronic apparatus receives a notification message, the electronic apparatus determines whether to transmit the notification message to the wearable device according to a current mode; and when the wearable device receives the notification message from the electronic apparatus via the communication module, the servomotor is driven based on the notification message to rotate the second rotating plate, so that one of the notification items corresponding to the notification message is displayed in the second opening.

4. The notification system based on the wearable device according to claim 1, wherein the wearable device further comprises:

a plurality of contacts disposed in the rotatable ring, wherein rotation of the rotatable ring brings part of the contacts into contact with part of the switches to obtain the control signal.

5. The notification system based on the wearable device according to claim 1, wherein the switches have different preset voltages, and a total voltage level obtained by calculating a total of the preset voltages of the part of the switches that are triggered serves as the control signal.

6. The notification system based on the wearable device according to claim 1, wherein the communication module is a Bluetooth unit.

7. A wearable device, comprising:

a rotatable ring;

a plurality of switches, part of which are triggered through rotation of the rotatable ring to obtain a control signal; and a communication module coupled to the switches and transmitting a mode signal to an electronic apparatus in response to the control signal, so that the electronic apparatus switches to a corresponding mode based on the mode signal, a first rotating plate engaged with the rotatable ring and rotating with the rotatable ring, wherein a surface of the first rotating plate has a plurality of mode names, wherein the rotatable ring comprises a hollow area to expose a fixing panel, the fixing panel is disposed above the first rotating plate, and the fixing panel has a first opening to expose one of the mode names, the first rotating plate is driven to rotate by the rotatable ring, so that one of the mode names is exposed in the first opening and part of the switches are triggered to obtain the control signal.

8. The wearable device according to claim 7, further comprising:

a second rotating plate comprising a plurality of notification items, wherein the fixing panel has a second opening to expose one of the notification items; and a servomotor driving the second rotating plate to rotate, wherein when the electronic apparatus receives a notification message, the electronic apparatus determines whether to transmit the notification message to the wearable device according to a current mode; and when the wearable device receives the notification message from the electronic apparatus via the communication module, the servomotor is driven based on the notification message to rotate the second rotating plate, so that one of the notification items corresponding to the notification message is displayed in the second opening.

9. The wearable device according to claim 7, further comprising:

a plurality of contacts disposed in the rotatable ring, wherein rotation of the rotatable ring brings part of the contacts into contact with part of the switches to obtain the control signal.

10. The wearable device according to claim 7, wherein the switches have different preset voltages, and a total voltage level obtained by calculating a total of the preset voltages of the part of the switches that are triggered serves as the control signal.

11. The wearable device according to claim 7, wherein the communication module is a Bluetooth unit.

12. A notification method for a wearable device and an electronic apparatus, the notification method comprising:

pairing the wearable device with the electronic apparatus, wherein the wearable device comprises an rotatable ring, a plurality of switches, a communication module, a first rotating plate engaged with the rotatable ring and rotating with the rotatable ring, and a surface of the first rotating plate has a plurality of mode names;

triggering part of the switches based on rotation of the rotatable ring to obtain a control signal;

transmitting a mode signal to the electronic apparatus via the communication module in response to the control signal; and switching the electronic apparatus to a corresponding mode based on the mode signal after the electronic apparatus receives the mode signal, driving the first rotating plate to rotate by the rotatable ring, so that one of the mode names is exposed in a first opening of a fixing panel and part of the switches are triggered to obtain the control signal, wherein the rotatable ring comprises a hollow area to expose the fixing panel, and the fixing panel is disposed above the first rotating plate.

13. The notification method according to claim 12, further comprising:

determining whether to transmit a notification message to the wearable device according to a current mode when the electronic apparatus receives the notification message; and driving a servomotor based on the notification message to rotate a second rotating plate, so that a notification item of the second rotating plate corresponding to the notification message is displayed in a second opening of the fixing panel when the wearable device receives the notification message from the electronic apparatus via the communication module.

14. The notification method according to claim 12, wherein the wearable device further comprises a plurality of contacts disposed in the rotatable ring, and the notification method further comprises:

bringing part of the contacts into contact with part of the switches through rotation of the rotatable ring to obtain the control signal.

15. The notification method according to claim 12, wherein the switches have different preset voltages, and a total voltage level obtained by calculating a total of the preset voltages of the part of the switches that are triggered serves as the control signal.

16. The notification method according to claim 12, wherein the communication module is a Bluetooth unit.

* * * * *